US009228455B1

(12) United States Patent
Belter et al.

(10) Patent No.: US 9,228,455 B1
(45) Date of Patent: Jan. 5, 2016

(54) OUTBOARD MOTORS AND MARINE ENGINES HAVING CAM PHASER ARRANGEMENTS

(71) Applicant: Brunswick Corporation, Lake Forest, IL (US)

(72) Inventors: David J. Belter, Oshkosh, WI (US); Ryan E. Mueller, Ripon, WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 14/202,051

(22) Filed: Mar. 10, 2014

Related U.S. Application Data

(60) Provisional application No. 61/782,829, filed on Mar. 14, 2013.

(51) Int. Cl.

| | |
|---|---|
| ***F01L 1/34*** | (2006.01) |
| ***F01L 1/344*** | (2006.01) |
| ***B63H 20/00*** | (2006.01) |

(52) U.S. Cl.
CPC ..... *F01L 1/344* (2013.01); *B63H 20/00* (2013.01); *F01L 1/3442* (2013.01)

(58) Field of Classification Search
CPC ..... F01L 2001/34456; F01L 2001/34453; F01L 2001/3445; F01L 1/3442; F01L 2001/34486; F01L 2001/34489; F01L 2001/34493; F01L 2001/34496; F01L 1/053; F01L 2001/34476; F01L 2001/34473; F01L 2001/34469; F01L 2001/34463; F01L 2001/34459
See application file for complete search history.

(56) References Cited

U.S. PATENT DOCUMENTS

| | | | | |
|---|---|---|---|---|
| 5,107,804 | A | 4/1992 | Becker et al. | |
| 5,327,859 | A | 7/1994 | Pierik et al. | |
| 5,447,126 | A | 9/1995 | Kondoh et al. | |
| 5,588,404 | A | 12/1996 | Lichti et al. | |
| 5,680,836 | A | 10/1997 | Pierik | |
| 5,680,837 | A | 10/1997 | Pierik | |
| 5,813,378 | A | 9/1998 | Sato | |
| 6,129,060 | A | 10/2000 | Koda | |
| 6,176,210 | B1 | 1/2001 | Lichti et al. | |
| 6,247,434 | B1 | 6/2001 | Simpson et al. | |
| 6,276,321 | B1 | 8/2001 | Lichti et al. | |
| 6,405,696 | B1 | 6/2002 | Borraccia et al. | |
| 6,412,462 | B1 | 7/2002 | Lichti et al. | |
| 6,691,656 | B1 | 2/2004 | Pierik et al. | |
| 6,742,485 | B2 | 6/2004 | Lichti | |
| 6,843,214 | B1 | 1/2005 | Herrin | |
| 6,915,775 | B2 | 7/2005 | Patterson et al. | |
| 6,997,150 | B2 | 2/2006 | Simpson | |
| 7,647,904 | B2 | 1/2010 | Farah et al. | |
| 7,755,077 | B2 | 7/2010 | Inaba | |
| 7,789,054 | B2 | 9/2010 | Rozario et al. | |
| 8,453,616 | B2 | 6/2013 | Eimert | |
| 8,584,636 | B2 | 11/2013 | David et al. | |
| 2002/0050257 | A1* | 5/2002 | Watanabe | 123/90.17 |
| 2006/0213469 | A1* | 9/2006 | Ezaki et al. | 123/90.16 |
| 2009/0044772 | A1* | 2/2009 | Purcilly et al. | 123/90.31 |

* cited by examiner

*Primary Examiner* — Jesse Bogue
*Assistant Examiner* — Daniel Bernstein
(74) *Attorney, Agent, or Firm* — Andrus Intellectual Property Law, LLP

(57) ABSTRACT

A marine engine for an outboard motor comprises a bank of piston-cylinders, an intake camshaft that operates intake valves for controlling inflow of air to the bank of piston-cylinders, an exhaust camshaft that operates exhaust valves for controlling outflow of exhaust gas from the bank of piston-cylinders, and a cam phaser disposed on one of the intake camshaft and exhaust camshaft. The cam phaser is connected to and adjusts a timing of operation of the other of the intake camshaft and exhaust camshaft with respect to the one of the intake camshaft and exhaust camshaft.

10 Claims, 4 Drawing Sheets

OUTBOARD MOTORS AND MARINE ENGINES HAVING CAM PHASER ARRANGEMENTS

CROSS-REFERENCE TO RELATED APPLICATION

The present application relates to and claims priority of U.S. Provisional Patent Application Ser. No. 61/782,829, filed Mar. 14, 2013, which is incorporated herein by reference in entirety.

FIELD

The present disclosure relates to internal combustion engines for marine engines, and particularly to cam phaser arrangements for outboard motors and marine engines for outboard motors.

BACKGROUND

Cam phasers are known in the art for increasing efficiency and improving idle stability of internal combustion engines. Examples of cam phasers for internal combustion engines are disclosed in the following U.S. Patents, which are incorporated herein by reference: U.S. Pat. Nos. 5,107,804; 5,327,859; 5,447,126; 5,588,404; 5,680,836; 5,680,837; 5,813,378; 6,129,060; 6,176,210; 6,247,434; 6,276,321; 6,405,696; 6,412,462; 6,691,656; 6,742,485; 6,843,214; 6,915,775; 6,997,150; 7,755,077; 7,647,904; 7,789,054; 8,453,616; 8,584,636.

SUMMARY

This Summary is provided to introduce a selection of concepts that are further described herein below in the Detailed Description. This Summary is not intended to identify key or essential features of the claimed subject matter, nor is it intended to be used as an aid in limiting the scope of the claimed subject matter.

In certain examples, marine engines comprise a bank of piston-cylinders; an intake camshaft that operates intake valves for controlling inflow of air to the bank of piston-cylinders; an exhaust camshaft that operates exhaust valves for controlling outflow of exhaust gas from the bank of piston-cylinders; and a cam phaser disposed on one of the intake camshaft and exhaust camshaft. The cam phaser is operably connected to and adjusts a timing of operation of the other of the intake camshaft and exhaust camshaft with respect to the one of the intake camshaft and exhaust camshaft.

In certain examples, outboard motors and marine engines for outboard motors comprise first and second banks of piston-cylinders that are aligned with respect to a longitudinal axis and extend transversely to each other in a V-shape so as to define a valley therebetween. A crankshaft extends along the longitudinal axis. Combustion in the first and second banks of piston-cylinders causes rotation of the crankshaft. A dual overhead cam arrangement is provided for each of the first and second banks of piston-cylinders. Each dual overhead cam arrangement is connected to the crankshaft and controls flow of intake air and exhaust gas to and from a respective one of the first and second banks of piston-cylinders upon rotation of the crankshaft. Each dual overhead cam arrangement comprises an exhaust camshaft and an intake camshaft. The crankshaft is coupled to one of the exhaust camshaft and intake camshaft such that rotation of the crankshaft causes rotation of the one of the exhaust camshaft and intake camshaft. A cam phaser is disposed on the one of the intake camshaft and exhaust camshaft. The cam phaser is connected to the other of the intake camshaft and exhaust camshaft so as to adjust a timing of rotation of the other of intake camshaft and the exhaust camshaft with respect to the one of the intake camshaft and exhaust camshaft.

BRIEF DESCRIPTION OF THE DRAWINGS

Examples of outboard motors and internal combustion engines for outboard motors are described with reference to the following figures. The same numbers are used throughout the figures to reference like features and components.

DETAILED DESCRIPTION OF THE DRAWINGS

In the present description, certain terms have been used for brevity, clarity, and understanding. No unnecessary limitations are to be inferred therefrom beyond the requirement of the prior art because such terms are used for descriptive purposes and are intended to be broadly construed. The different systems and apparatuses described herein may be used alone or in combination with other systems and methods. It is to be expected that various equivalents, alternatives and modifications are possible within the scope of the appended claims. Each limitation in the appended claims is intended to invoke interpretation under 35 U.S.C. §112(f), only if the terms "means for" or "step for" are explicitly recited in the respective limitation.

Figure 1:
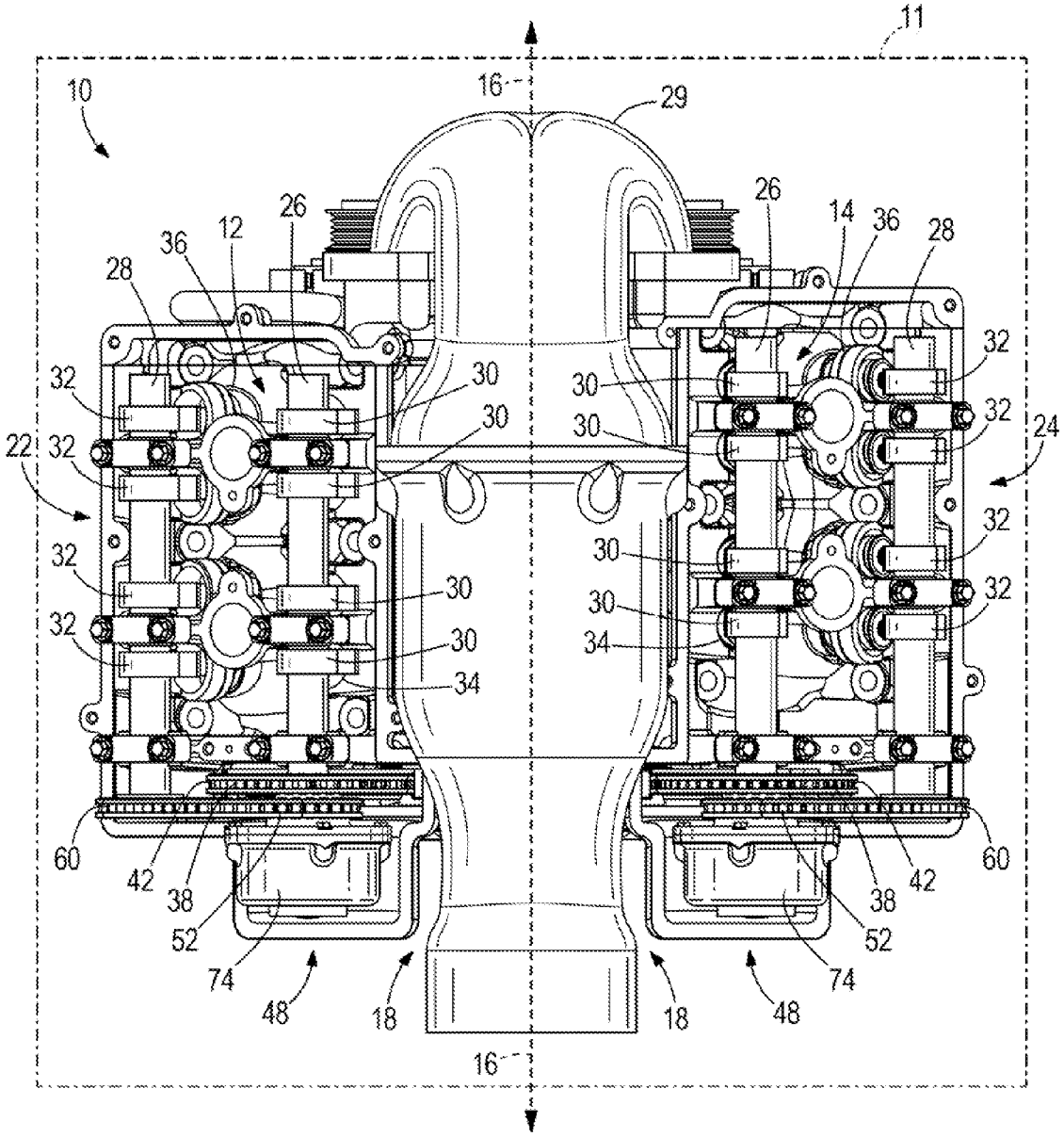
FIG. 1 is a rear view of a marine engine.
Figure 2:
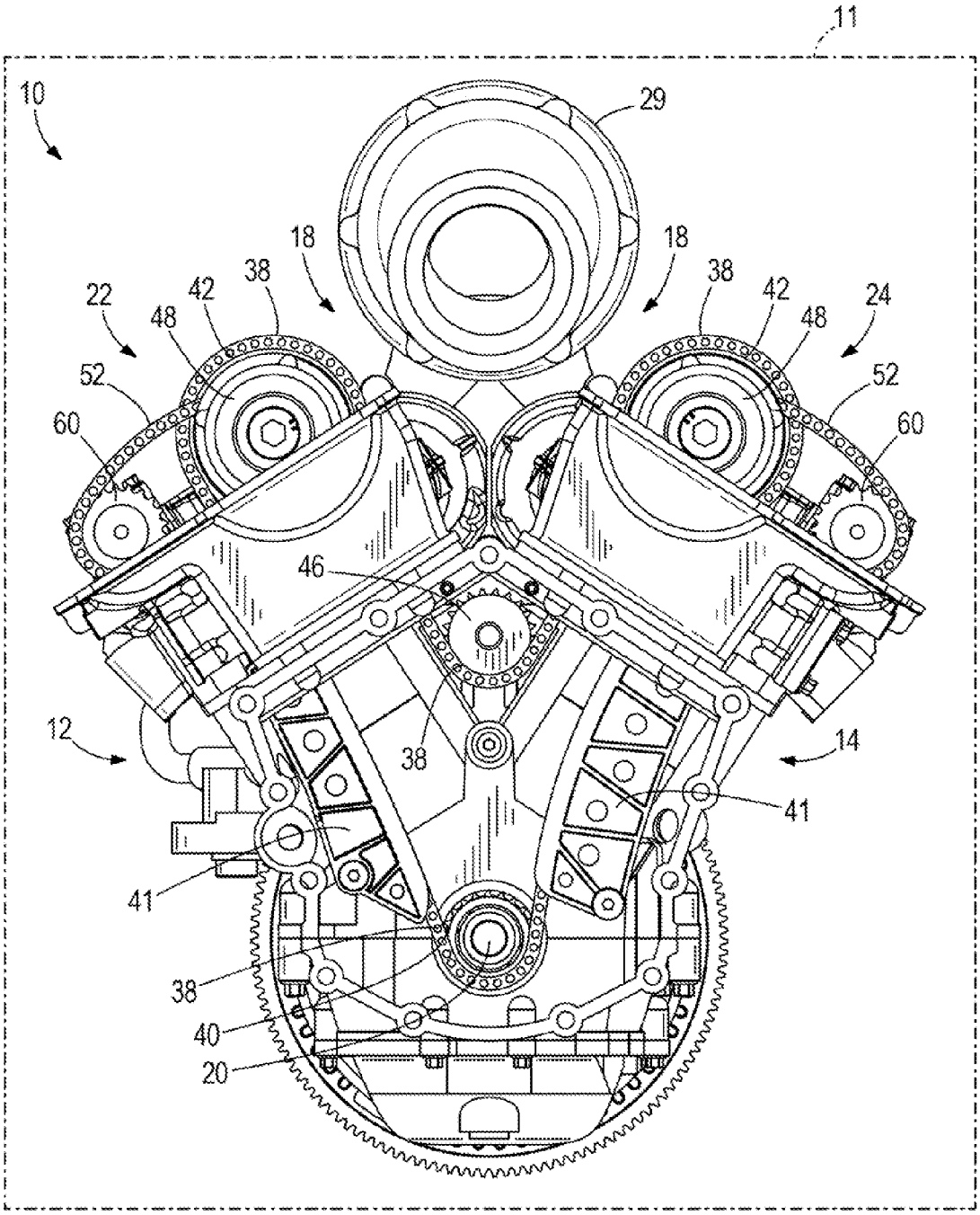
FIG. 2 is a bottom view of the marine engine shown in FIG. 1.

FIGS. 1-2 depict a marine internal combustion engine 10 for an outboard motor 11. The engine 10 has first and second banks of piston-cylinders 12, 14 that are disposed along a vertical, longitudinal axis 16. The first and second banks of piston-cylinders 12, 14 extend transversely from each other and transversely from the longitudinal axis 16 in a V-shape (see FIG. 2) so as to define a valley 18 there between. As is conventional, combustion of air and fuel in the first and second banks of piston-cylinders 12, 14 causes reciprocation of pistons (not shown) in the banks of piston-cylinders 12, 14, which via connecting rods (not shown), causes rotation of a crankshaft 20 about the longitudinal axis 16.

Returning to FIGS. 1-5, dual overhead cam arrangements 22, 24 are disposed on each of the first and second banks of piston-cylinders 12, 14. The dual overhead cam arrangements 22, 24 are configured such that rotation of the crankshaft 20 (see FIG. 3, arrows A) about the longitudinal axis 16 allows flow of intake air to the first and second banks of piston-cylinders 12, 14 and allows flow of exhaust gas from the first and second banks of piston-cylinders 12, 14. More specifically, each dual overhead cam arrangement 22, 24 includes an exhaust camshaft 26 and an intake camshaft 28. The exhaust camshaft 26 and intake camshaft 28 extend parallel to each other and extend parallel to the longitudinal axis 16 shown in FIG. 1. As shown in FIGS. 1 and 2, the exhaust camshaft 26 is located closer to the valley 18 than the intake camshaft 28.

Each of the camshafts 26, 28 carries cam lobes 30, 32 that operate exhaust and intake valves 34, 36, respectively, on the first and second banks of piston-cylinders 12, 14. The exhaust valves 34 are located closer to the valley 18 than the intake valves 36. As explained further hereinbelow, rotation of the crankshaft 20 (arrows A) causes rotation of the camshafts 26, 28 (see FIG. 3, arrows B, C), which causes rotation of the cam lobes 30, 32, which in turn cams open the exhaust and intake valves 34, 36, respectively. Continued rotation of the camshafts 26, 28, further rotates the cam lobes 30, 32, which allows springs 31 on the exhaust and intake valves 34, 36 to close the exhaust and intake valves 34, 36, respectively. This opening/closing cycle repeats during the combustion process to allow intake air into the piston-cylinders 12, 14 for combustion and to emit exhaust gas from the piston-cylinders 12, 14 for discharge. An exhaust conduit 29 carries exhaust gas from the piston-cylinders 12, 14.

Combustion in the first and second banks of piston-cylinders 12, 14 causes rotation of the crankshaft 20 (arrows A), which in turn causes rotation of the respective exhaust camshafts 26 (arrows B). The crankshaft 20 is operatively connected to the exhaust camshafts 26 via a flexible connector, which in this example is a chain 38. The type of connector can vary and in certain examples can include a belt and/or the like. The chain 38 is driven into movement by a drive sprocket 40, which is disposed on the crankshaft 20 and engaged with the chain 38. Movement of the chain 38 engages with sprockets 42 on the respective exhaust camshafts 26, thereby causing rotation of the exhaust camshafts 26 (arrows B) about their own axes. An idler sprocket 46 is located at a center of the valley 18. The idler sprocket 46 is engaged with and driven into rotation about its own axis (arrows E) by movement of the chain 38. The idler sprocket 46 supports movement of the chain 38. Movement of the chain is also supported by conventional chain guides 41.

Figure 6:
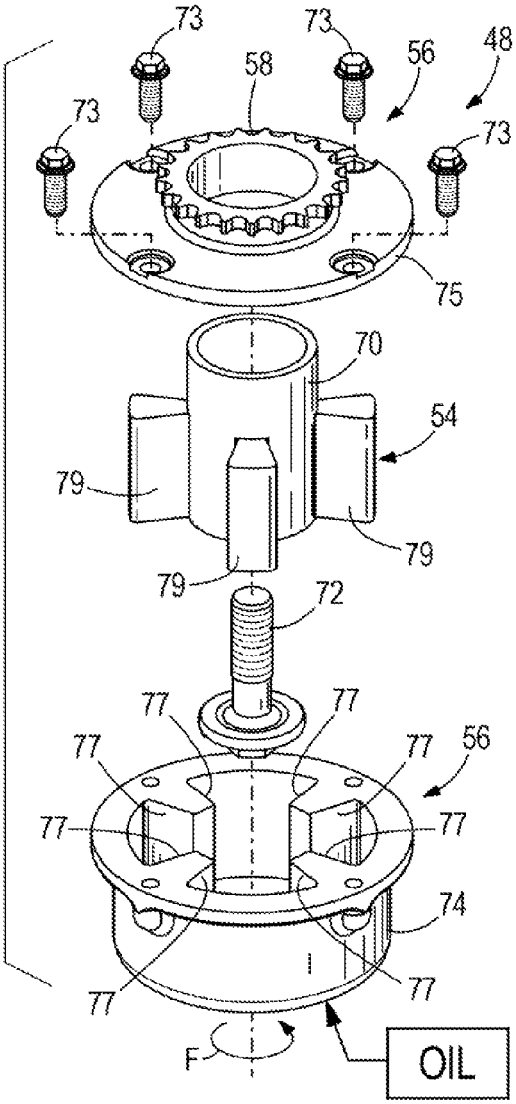
FIG. 6 is an exploded view of one example of the cam phaser.

As shown in FIGS. 1-6, a cam phaser 48 is disposed on the lower end 50 of each of the exhaust camshafts 26. The cam phasers 48 also are operably connected to the respective intake camshafts 28 so as to adjust the timing of rotation of the intake camshafts 28 with respect to the timing of rotation of the exhaust camshafts 26 and the crankshaft 20 (i.e. so as to adjust the phase shown at arrows C in FIG. 3 with respect to the phase shown at arrows B in FIG. 3). The cam phasers 48 are located closer to the valley 18 than the intake camshafts 28. As shown in FIG. 6, each cam phaser 48 includes a rotor portion 54 that is rigidly connected to and rotates with the respective exhaust camshaft 26 and a stator portion 56 that is rotationally connected to the respective intake camshaft 28 via the chain 52. The type of cam phaser that is implemented with this invention can vary from that shown. Thus the configuration of the rotor portion 54 and stator portion 56 can vary from that which is shown, depending upon the particular configuration of the cam phaser 48. For example, the type of cam phaser can include one of the cam phasers disclosed in the U.S. Patents that are incorporated herein by reference in the Background section of this disclosure. The cam phaser can be electrically actuated, hydraulically actuated or actuated by cam torque. The example of the cam phaser 48 shown in the drawings is relatively simplistic to assist the reader to understand the nature of the invention; however it is recognized by the present inventors that the cam phaser can alternately include more or less components and functions than that which is shown.

In the example of the cam phaser 48 shown in FIG. 6, the rotor portion 54 includes a star wheel 70 having radially extending arms 79. The star wheel 70 is fixedly attached to the lower end 50 of the exhaust camshaft 26 by a bolt 72. The star wheel 70 rotates with the exhaust camshaft 26 (arrows B). The stator portion 56 includes a housing 74 that houses the rotor portion 54 and a plate 75 to which the housing 74 is attached by bolts 73. The stator portion 56 is rotatable about its own axis (arrow F) with respect to rotation of the rotor portion 54 (and thus with respect to rotation of the exhaust camshaft 26) between limits defined by physical engagement between the arms 79 of the star wheel 70 and the interior engagement surfaces 77 of the housing 74. As is conventional, the housing 74 is supplied with oil at a predetermined pressure, which determines relative rotation of the stator portion 56 with respect to the rotor portion 54. Reference is made to the incorporated US Patents for additional background regarding this type of cam phaser structure and functionality.

Figure 4:
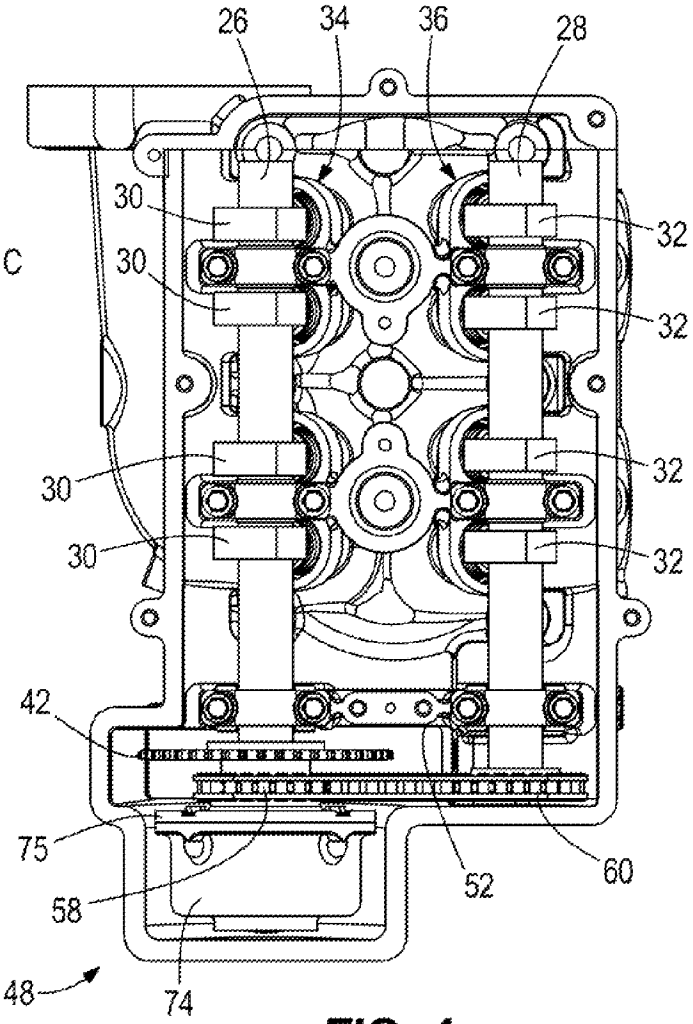
FIG. 4 is a view of one of the dual overhead cam arrangements.
Figure 3:
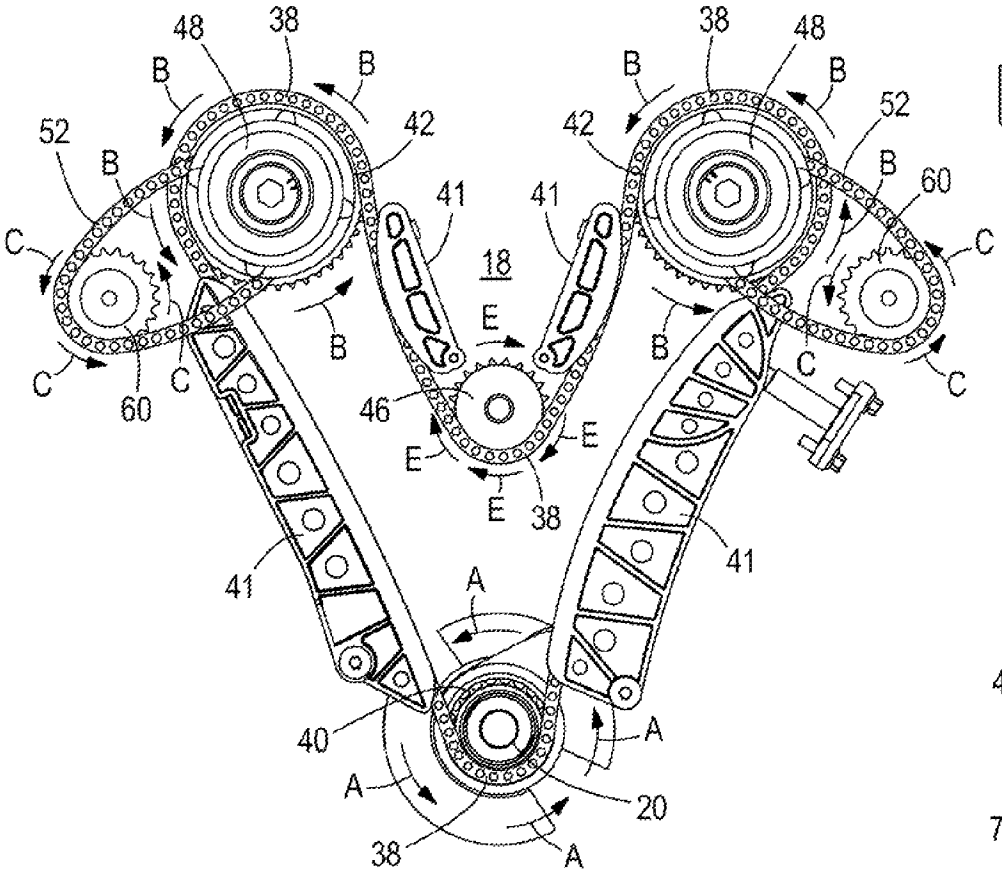
FIG. 3 is a view of a crankshaft and a pair of dual overhead cam arrangements for the marine engine shown in FIG. 1.
Figure 5:
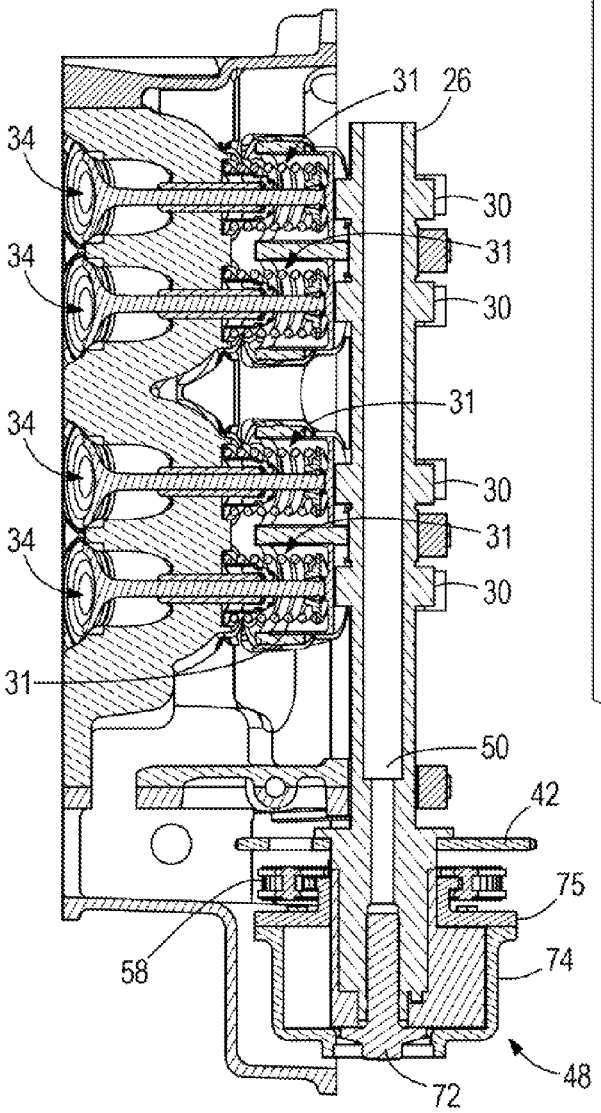
FIG. 5 is a section view of a cam phaser disposed on an exhaust camshaft of the dual overhead cam arrangement shown in FIG. 4.

Referring to FIGS. 3 and 4, a flexible connector connects a sprocket 58 on the plate 75 to a sprocket 60 on the intake camshaft 28. In this example the flexible connector includes the chain 52; however the type of connector can vary and in certain examples can include a belt, and/or the like. Rotation of the stator portion 56 causes movement of the chain 52, which in turn causes rotation of the intake camshaft 28 (arrows C). Rotation of the stator portion 56 is phased with respect to rotation of the rotor portion 54, in part based upon the oil pressure supplied to the housing 74 and the geometry and physical interaction between the rotor portion 54 and stator portion 56, as is conventional. Thus, rotation of the intake camshaft 28 (arrows C) is phased with respect to rotation of the exhaust camshaft 26 (arrows B) by the cam phaser 48 disposed on the exhaust camshaft 26.

In this example, the cam phaser 48 is disposed on the lower end 50 of the respective exhaust camshafts 26. The present inventors have found that by locating the cam phaser 48 on the lower end 50 of the respective exhaust camshafts 26, closer to the valley 18 than the respective intake camshafts 28, it is possible to provide phasing to the intake camshaft 28 and yet save critical design space on the outboard motor. For example, dual large outboard motors that are mounted on boats typically have a requirement to meet 26 inch centers. This restricts the allowable width of each outboard motor. Conventional cam phasing concepts otherwise add to the width of the outboard motor and in some cases make the outboard motor too wide to fit on the 26 inch centers. The arrangements in the present disclosure overcome these drawbacks. By placing the cam phaser 48 on the exhaust cam shaft 26, the cam phaser 48 does not contribute to the overall width of the outboard motor 11. The exhaust cam shaft 26 favorably provides a bearing surface for the rotor portion 54 of the cam phaser 48, thus phasing the intake cam shaft 28 but not the exhaust cam shaft 26.

What is claimed is:

1. An engine comprising:

a bank of piston-cylinders;

an intake camshaft that operates intake valves for controlling inflow of air to the bank of piston-cylinders;

an exhaust camshaft that operates exhaust valves for controlling outflow of exhaust as from the bank of piston-cylinders; and a cam phaser disposed on one of the intake camshaft and exhaust camshaft, the cam phaser being operably connected to and adjusting a timing of operation of the other of the intake camshaft and exhaust camshaft with respect to the one of the intake camshaft and exhaust camshaft; and a crankshaft that is operably connected to the one of the intake camshaft and exhaust camshaft, wherein combustion in the bank of piston-cylinders causes rotation of the crankshaft, which in turn causes rotation of the one of the intake camshaft and exhaust camshaft;

wherein the cam phaser comprises a rotor portion that is rigidly connected to and rotates with the one of the intake camshaft and exhaust camshaft; and wherein the cam phaser comprises a stator portion that is connected to the other of the intake camshaft and the exhaust camshaft, and wherein the stator portion rotates with respect to the rotor portion to thereby adjust the timing of operation of the other of the intake camshaft and exhaust camshaft with respect to the crankshaft.

2. The engine according to claim 1, wherein the one of the intake camshaft and exhaust camshaft is the exhaust camshaft, and wherein the other of the intake camshaft and exhaust camshaft is the intake camshaft.

3. The engine according to claim 1, wherein the exhaust camshaft and intake camshaft are part of a dual overhead cam arrangement.

4. The engine according to claim 1, comprising a connector that connects the cam phaser to the other of the intake camshaft and exhaust camshaft.

5. The engine according to claim 4, wherein the connector comprises a chain.

6. The engine according to claim 1, comprising a connector that connects the crankshaft to the one of the intake camshaft and exhaust camshaft.

7. The engine according to claim 6, wherein the connector comprises a chain.

8. The engine according to claim 1, comprising a first connector that operably connects the crankshaft to the exhaust camshaft and a second connector that operably connects the stator portion of the cam phaser to the intake camshaft.

9. An engine comprising:

first and second banks of piston-cylinders that are aligned with respect to a longitudinal axis and extend transversely to each other in a V-shape so as to define a valley therebetween;

a crankshaft that extends along the longitudinal axis, wherein combustion in the first and second banks of piston-cylinders causes rotation of the crankshaft;

a dual overhead cam arrangement for each of the first and second banks of piston-cylinders, each dual overhead cam arrangement being connected to the crankshaft and controlling flow of intake air and exhaust gas to and from a respective one of the first and second banks of piston-cylinders upon rotation of the crankshaft;

wherein each dual overhead cam arrangement comprises an exhaust camshaft and an intake camshaft;

wherein the crankshaft is coupled to one of the exhaust camshaft and intake camshaft such that rotation of the crankshaft causes rotation of the one of the exhaust camshaft and intake camshaft; and a cam phaser disposed on the exhaust camshaft, wherein the cam phaser is operably connected to the intake camshaft so as to adjust a timing of rotation of the intake camshaft with respect to the exhaust camshaft;

wherein the exhaust camshaft and intake camshaft extend parallel to the longitudinal axis, wherein the exhaust camshaft is disposed closer to the valley than the intake camshaft, wherein the cam phaser is disposed on an end of the exhaust camshaft;

wherein the cam phaser comprises a rotor portion that is rigidly connected to and rotates with the exhaust camshaft and a stator portion that is connected to the intake camshaft, and wherein the stator portion is rotationally phased with respect to the rotor portion to thereby adjust the timing of operation of the intake camshaft with respect to the crankshaft.

10. An outboard motor comprising:

a marine engine having first and second banks of piston-cylinders that are disposed along a vertical longitudinal axis and extend transversely to each other in a V-shape so as to define a valley therebetween;

a crankshaft that extends along the longitudinal axis, wherein combustion in the first and second banks of piston-cylinders causes rotation of the crankshaft;

a dual overhead cam arrangement for each of the first and second banks of piston-cylinders, each dual overhead cam arrangement being connected to the crankshaft and controlling flow of intake air and exhaust gas to and from a respective one of the first and second banks of piston-cylinders upon rotation of the crankshaft;

wherein each dual overhead cam arrangement comprises an exhaust camshaft and an intake camshaft wherein the exhaust camshaft and the intake camshaft both extend parallel to the longitudinal axis;

wherein the crankshaft is operatively coupled to the exhaust camshaft such that rotation of the crankshaft causes rotation of the exhaust camshaft;

a cam phaser disposed on the exhaust camshaft, wherein the cam phaser is operably connected to the intake camshaft so as to adjust a timing of rotation of the intake camshaft with respect to the exhaust camshaft;

wherein the exhaust camshaft is disposed closer to the valley than the intake camshaft, wherein the exhaust camshaft comprises a first end and a vertically higher second end, and wherein the cam phaser is disposed on the first end;

wherein the cam phaser comprises a rotor portion that is rigidly connected to and rotates with the exhaust camshaft and a stator portion that is connected to the intake camshaft, and wherein the stator portion is rotationally phased with respect to the rotor portion to thereby adjust the timing of operation of the intake camshaft with respect to the crankshaft; and a first connector that connects the crankshaft to the exhaust camshaft and a second connector that connects the second portion of the cam phaser to the intake camshaft.

* * * * *